US009979135B2

(12) United States Patent
Hwangbo

(10) Patent No.: US 9,979,135 B2
(45) Date of Patent: May 22, 2018

(54) CONNECTOR

(71) Applicant: Samsung Electronics Co., Ltd., Suwon-si (KR)

(72) Inventor: Hoon Hwangbo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days. days.

(21) Appl. No.: 15/386,713

(22) Filed: Dec. 21, 2016

(65) Prior Publication Data

US 2017/0214187 A1 Jul. 27, 2017

(30) Foreign Application Priority Data

Jan. 27, 2016 (KR) ..... 10-2016-0009835

(51) Int. Cl.
*H01R 13/6594* (2011.01)

(52) U.S. Cl.
CPC ..... *H01R 13/6594* (2013.01)

(58) Field of Classification Search
CPC ..... H01R 13/6594; H01R 13/6595; H01R 23/6873; H01R 23/7073
USPC ..... 439/607.35, 607.38, 607.4
See application file for complete search history.

(56) References Cited

U.S. PATENT DOCUMENTS 5,660,558 A * 8/1997 Osanai ..... H01R 13/508 439/353
6,932,640 B1 8/2005 Sung
7,182,641 B2 2/2007 Shimoyama
7,405,363 B2 * 7/2008 Inoue ..... H05K 1/117 174/255
7,789,706 B2 * 9/2010 Chen ..... H01R 13/504 439/607.35
7,887,370 B2 * 2/2011 Chen ..... H01R 13/506 439/607.35
8,011,969 B2 * 9/2011 Wang ..... H01R 13/65802 439/607.35
8,366,486 B1 * 2/2013 Lan ..... H01R 13/6582 439/607.35
8,460,034 B2 * 6/2013 Song ..... H01R 12/57 439/607.36
8,801,467 B2 * 8/2014 Lan ..... H01R 12/724 439/607.36
9,331,030 B1 * 5/2016 Tsai ..... H01L 23/66
(Continued)

FOREIGN PATENT DOCUMENTS

JP 2007-5234 1/2007
JP 2010-218712 9/2010
(Continued)

OTHER PUBLICATIONS

International Search Report and Written Opinion of the International Searching Authority dated Apr. 14, 2017 in International Patent Application No. PCT/KR2016/015451.

*Primary Examiner* — Gary Paumen
(74) *Attorney, Agent, or Firm* — Staas & Halsey LLP

(57) ABSTRACT

A connector having an improved shield performance and EMI shield structure are provided. The connector includes a conductive terminal, a fixed body configured to accommodate the conductive terminal therein, and a shield housing having an open lower portion through which a lower end portion of the conductive terminal is connected to a printed circuit board and formed in a body to accommodate the conductive terminal and the fixed body.

19 Claims, 10 Drawing Sheets

(56) References Cited

U.S. PATENT DOCUMENTS

| | | | | |
|---|---|---|---|---|
| 2004/0157491 | A1 | 8/2004 | Lin | |
| 2006/0292930 | A1 | 12/2006 | Shimoyama | |
| 2008/0248675 | A1 | 10/2008 | Lin et al. | |
| 2009/0253297 | A1* | 10/2009 | Kamata ..... | H01R 13/6275 439/607.35 |
| 2010/0233905 | A1 | 9/2010 | Nagata | |
| 2011/0086546 | A1 | 4/2011 | Mao et al. | |
| 2016/0197433 | A1 | 7/2016 | Choi et al. | |

FOREIGN PATENT DOCUMENTS

| | | |
|---|---|---|
| JP | 2011-192409 | 9/2011 |
| KR | 10-1412127 | 6/2014 |
| KR | 10-2015-0040207 | 4/2015 |
| KR | 10-2015-0040737 | 4/2015 |

* cited by examiner

CONNECTOR

CROSS-REFERENCE TO RELATED APPLICATIONS

This application claims priority from Korean Patent Application No. 10-2016-0009835 filed on Jan. 27, 2016 in the Korean Intellectual Property Office, the disclosure of which is incorporated herein by reference in its entirety.

BACKGROUND

1. Field

The present disclosure relates to a connector having an improved shielding function.

2. Description of the Related Art

With the developments of technology, an electronic device, such as a TV, monitor, computer, or a portable terminal, can implement diverse functions, such as video output, web surfing, gaming, photography, and moving images capture.

Further, an electronic device may be connected to an external device by wire to transmit data.

For example, a USB memory may be connected to a TV, and data, such as a movie, music, or a photograph, which is stored in the USB memory, may be output through the TV or a monitor. For this, a USB port for connecting the memory to the TV or monitor should be provided in the TV.

In general, in order to connect to an external storage medium or another electronic device, the electronic device is provided with a connector, into which a terminal of USB or HDMI type is inserted to be electrically connected thereto.

Since such a connector serves as a mediator to connect a PCB and a cable to each other, impedance matching technology is required, and there is a need for technology that can completely shield noise that occurs in a signal.

SUMMARY

Additional aspects and/or advantages will be set forth in part in the description which follows and, in part, will be apparent from the description, or may be learned by practice of the embodiments.

Exemplary embodiments of the present disclosure overcome the above disadvantages and other disadvantages not described above, and provide a connector having an improved shielding performance.

According to an aspect of the present disclosure, a connector includes a conductive terminal; a fixed body configured to accommodate the conductive terminal therein; and a shield housing having an open lower portion through which a lower end portion of the conductive terminal is connected to a printed circuit board and formed in a body to accommodate the conductive terminal and the fixed body, wherein a bottom surface of the shield housing comes in contact with the printed circuit board to make the lower end portion of the conductive terminal closed from an outside.

According to another aspect of the present disclosure, a connector mounted on a printed circuit board, on which a via-hole for connecting a circuit pattern of a multilayered board layer and a through-hole penetratingly formed in a thickness direction are formed, includes a shield housing configured to accommodate therein a conductive terminal that electrically connects an external system and the circuit pattern to each other, wherein a connection pin that is provided on a bottom surface of the shield housing is inserted into the through-hole, and the bottom surface comes in contact with the printed circuit board to form an accommodation space that is closed from an outside.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION

Figure 1:
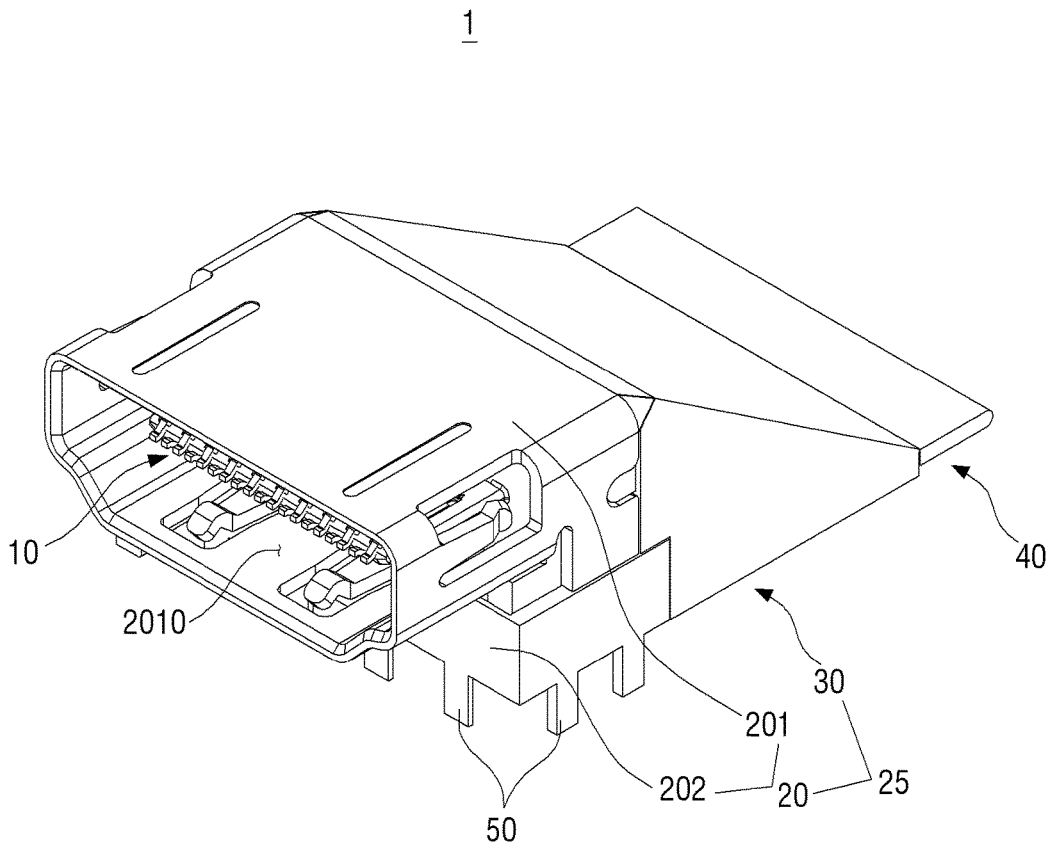
FIG. 1 is a perspective view illustrating a connector according to an embodiment of the present disclosure.

Reference will now be made in detail to the embodiments, examples of which are illustrated in the accompanying drawings, wherein like reference numerals refer to the like elements throughout. The embodiments are described below by referring to the figures.

Hereinafter, preferred embodiments of the present disclosure will be described in detail with reference to the accompanying drawings. However, it should be understood that the present disclosure is not limited to the specific embodiments described hereinafter, but includes various modifications, equivalents, and/or alternatives of the embodiments of the present disclosure.

In describing the embodiments of the present disclosure, all terms used in the description are terms that are defined in consideration of their functions in the present disclosure, and may differ depending on intentions of a user or an operator or customs. Accordingly, they should be defined on the basis of the contents of the whole description of the present disclosure. In relation to explanation of the drawings, similar drawing reference numerals may be used for similar constituent elements.

A connector 1, according to the present disclosure, is a connection portion of an electronic device, to which an external device is connected. The connector 1 may be provided a side of the electronic device so that the external device can be connected thereto. The external device may be a device which is connected to a memory device that can store data, such as videos or photographs, therein or an electronic device to execute driving of the electronic device. The connector 1 may be a connection terminal that conforms to the general standards.

The configuration that is connected to the connector 1 of the electronic device may be connected through a cable, such as a USB or HDMI cable. For example, the electronic device may be a certain electronic device, such as TV, computer, monitor, or measurement equipment, in which the connector 1 may be provided. The external device that is connected to the connector 1 of the electronic device may be implemented by a mobile terminal, such as a portable phone, a PDA, or an MP3 player, a camera, a printer, a scanner, a web cam, or an external hard disk, and the same electronic devices may be connected in symmetric configurations.

Figure 2:
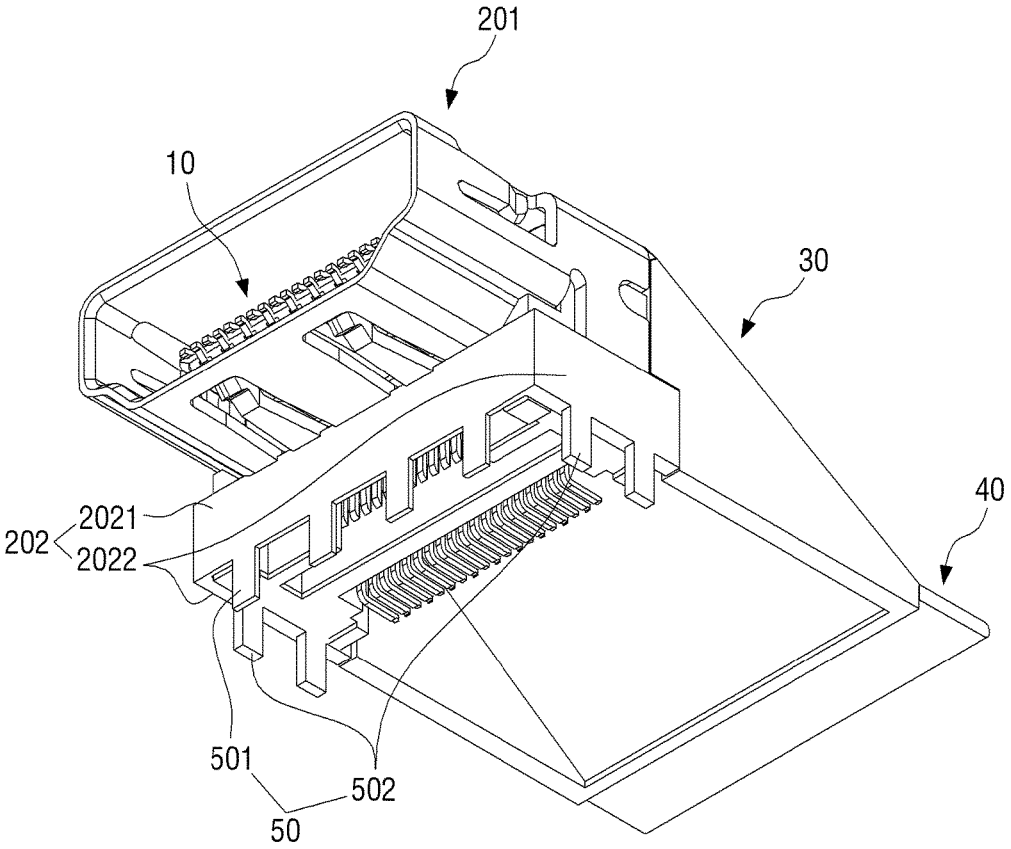
FIG. 2 is a perspective view illustrating a connector according to an embodiment of the present disclosure.
Figure 3:
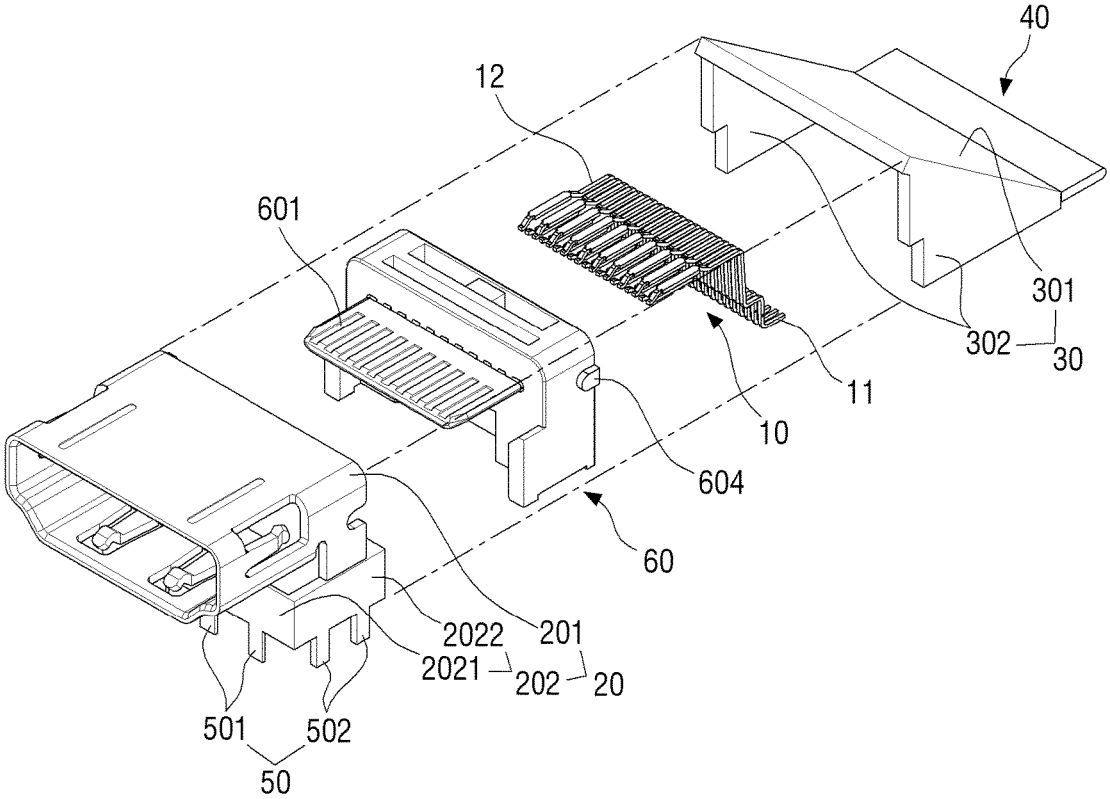
FIG. 3 is an exploded perspective view illustrating a connector according to an embodiment of the present disclosure.
Figure 4:
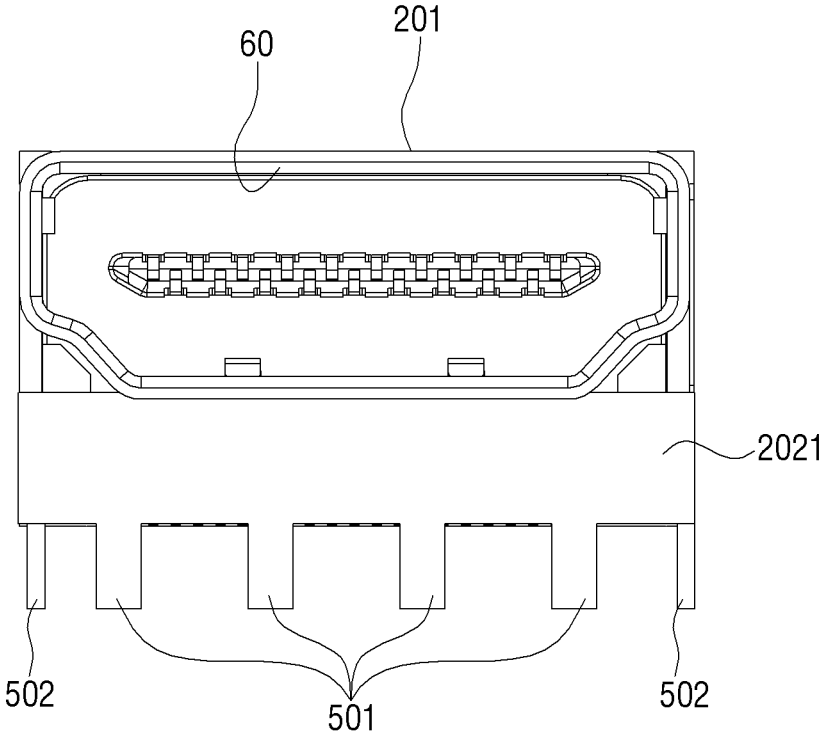
FIG. 4 is a front view illustrating a connector according to an embodiment of the present disclosure.
Figure 5:
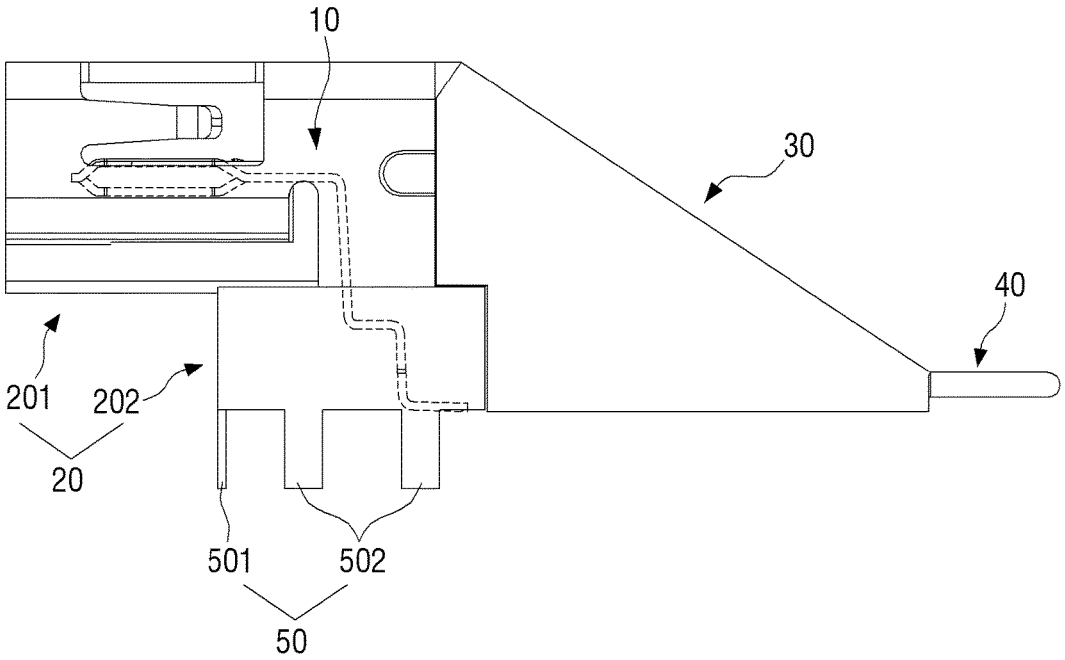
FIG. 5 is a side view illustrating a connector according to an embodiment of the present disclosure.
Figure 6:
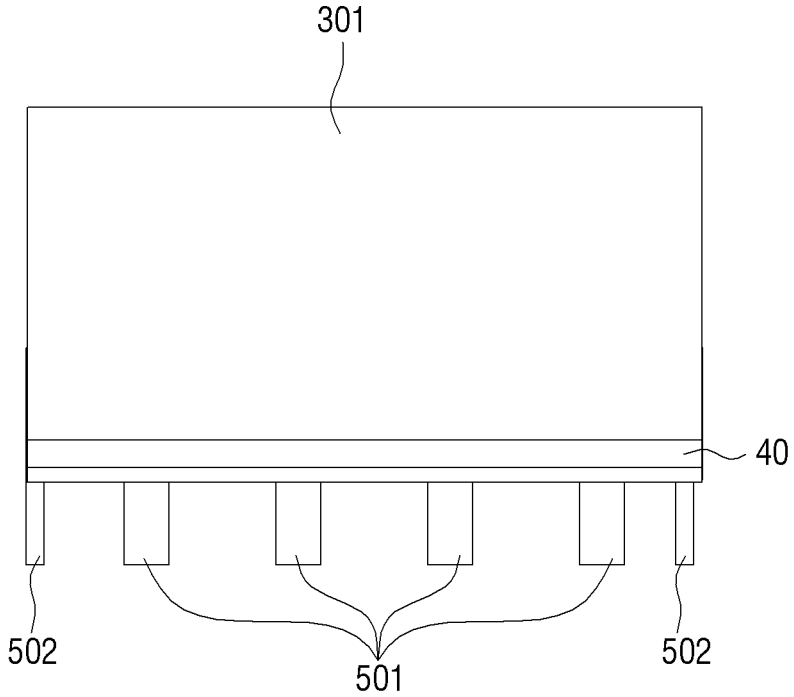
FIG. 6 is a rear view illustrating a connector according to an embodiment of the present disclosure.

FIG. 1 is a perspective view illustrating a connector according to an embodiment of the present disclosure, FIG. 2 is a perspective view illustrating a connector according to an embodiment of the present disclosure, and FIG. 3 is an exploded perspective view illustrating a connector according to an embodiment of the present disclosure. FIG. 4 is a front view illustrating a connector according to an embodiment of the present disclosure, FIG. 5 is a side view illustrating a connector according to an embodiment of the present disclosure, and FIG. 6 is a rear view illustrating a connector according to an embodiment of the present disclosure.

Referring to FIGS. 1 to 6, a connector 1 may include a conductive terminal 10, a fixed body 60 configured to accommodate and support the conductive terminal 10 therein, and a shield housing 25 configured to accommodate the fixed body 60 and to form an external appearance and provide noise signal or EMI (Electromagnetic Interference) sheilding.

The conductive terminal 10 may be electrically connected to an external system. A plurality of conductive terminals 10 may be provided, and the at least one conductive terminal 10 may include a power terminal through which a power is input and output. Further, although it is illustrated that the conductive terminal 10 is positioned in two rows at different heights, it is not limited thereto, and may be positioned in three rows or more at the same height. The number and the shape of the conductive terminals 10 may be variously changed.

The conductive terminal 10 is a constituent element that is mounted on a PCB (Printed Circuit Board) 70 (in FIG. 7) and comes into contact with an electrode of an external system (cable) to form a circuit that provides a mutual interface between a device that is connected to the cable and a device that is mounted on the PCB 70.

The conductive terminal 10 may be provided with an upper terminal portion 12 that comes in contact with the cable and a lower terminal portion 11 that is bent to extend from the upper terminal portion 12. The lower terminal portion 11 may be soldered to the PCB 70. An end portion of the upper terminal portion 12 is connected and electrically coupled to the cable, and the lower terminal portion 11 may be electrically coupled to a conducting wire (not illustrated) that is provided on the PCB 70.

In an embodiment of the present disclosure, it is exemplified that the lower terminal portion 11 has a plurality of bent portions in vertical and horizontal directions, but is not limited thereto. In accordance with the kind, size, or structure of the connector 1, the lower terminal portion 11 may have no bent portion, or may have bent portions that are arranged in different shapes.

The fixed body 60 may be an insulator that is provided to support the conductive terminal 10. The fixed body 60 may have a terminal support portion 601 that supports the conductive terminal 10, and the conductive terminal 10 that is supported by the terminal support portion 601 may be exposed to be connected to the cable through a hollow portion 2010 of the shield housing 25 to be described later. For example, the fixed body 60 may be formed by insert injection molding, and may be made of a resin material that can be injection-molded.

For example, the fixed body 60 may be shaped to surround the conductive terminal 10, and may be connected to the shield housing 25 so that the conductive terminal 10 can be positioned inside the shield housing 25. For example, fitting projections 604 may be formed on both side portions of the fixed body 60, and the fitting projections 604 may be inserted into and coupled to fastening grooves 2015 that are formed to be recessed on both side surfaces of a first body 201 to be described later. Accordingly, the fixed body 60 is guided to be fastened to the shield housing 25 with their mutual binding force increased. The fixed body 60 may be formed of an insulator to electrically separate the conductive terminal 10 and the shield housing 25 from each other.

The configurations of the conductive terminal 10 and the fixed body 60 can be understood from the known technology, and thus the detailed explanation thereof will be omitted.

Hereinafter, for easy understanding of the structure of the shield housing 25, respective constituent elements thereof will be separately explained. However, the shield housing 25 may be provided in a body with the PCB 70 so that it is completely sealed up with the PCB 70 in a seamless manner.

For example, the shield housing 25 may be formed by 3D printing, metal injection molding, or die casting. Further, various methods may be used in integrally forming the shield housing 25. The respective constituent elements thereof may be separately provided and then may be integrally connected to one another by a method, such as soldering.

Further, signal noise or Electromagnetic Interference (EMI) shielding to be described hereinafter may mean a phenomenon in which an electrical device in a predetermined space that is surrounded by an electrical conductor is not affected by an external electromagnetic field or an electromagnetic field that is generated in the space does not exert an influence on the outside.

The shield housing 25 has an accommodation space for accommodating the fixed body 60 therein, and forms an external appearance of the connector 1. Further, the shield housing 25 may have the same thickness. The shield housing 25 may be made of a metal material to provide an effect of shielding and reducing a magnetic field, and the metal may be, for example, aluminum, copper, or an alloy thereof.

The shield housing 25 may include a first cover portion 20 having a first body 201 into which a cable for connecting to an external system is inserted, and a second cover portion 30 that is connected to the rear of the first cover portion 20. In this case, the second cover portion 30 may be connected to the first cover portion 20 to provide the accommodation space for accommodating the fixed body 60.

The first body 201 may have the hollow portion 2010 having one open front side so that the conductive terminal 10 that is accommodated in the fixed body 60 can be connected to the cable. The hollow portion 2010 may provide a space into which the cable is inserted, and may be formed with a minimum size so that the cable is inserted into the hollow portion 2010. Further, the shape of the hollow portion 2010 may be changed to a shape that corresponds to the shape of the cable.

A first shield member 202 may be connected to a lower portion of the first body 201. The first shield member 202 may be shaped to surround a front and both sides of the fixed body 60. The first shield member 202 may be provided with a first front shield plate 2021 and a first side shield plate 2022. Here, the first front shield plate 2021 may be positioned in front of the fixed body 60, and the first side shield plate 2022 may be positioned on both sides of the fixed body 60.

A connection pin 50 may be provided on bottom surfaces of the first front shield plate 2021 and the first side shield plate 2022. The connection pin 50 may be provided with a first front connection pin 501 and a first side connection pin 502. Here, the first front connection pin 501 may be positioned on the bottom surface of the first front shield plate 2021, and the first side shield plate 502 may be positioned on the bottom surface of the first side shield plate 2022.

The first front connection pin 501 and the first side connection pin 502 may have the same cross-sectional area, and may have shapes that correspond to each other with the same height. In an embodiment of the present disclosure, if the first front shield plate 2021 has a width that is larger than the width of the first side shield plate 2022 that is positioned on one side thereof, the number of first front connection pins 501 may be larger than the number of the first side connection pins 502 that are positioned on one side thereof.

The first front connection pins 501 may be positioned to be spaced apart from one another at predetermined intervals along a length direction of the first front shield plate 2021, and the second front connection pins 502 may be positioned to be spaced apart from one another at predetermined intervals along a length direction of the first side shield plate 2022. Here, the intervals at which the first front connection pins 501 are positioned may be equal to or different from the intervals at which the second front connection pins 502 are positioned.

The numbers of the first front connection pins 501 and the first side connection pins 502 may be changed in accordance with the widths of the first front shield plate 2021 and the first side shield plate 2022. In addition, if the width of the first side shield plate 2022 is larger than the width of the first front shield plate 2021, the number of the first side connection pins 502 that are provided on one side of the first side shield plate 2022 may be larger than the number of the first front connection pins 501.

The first front connection pin 501 and the first side connection pin 502 may be inserted into through-holes 701 and 702 (in FIG. 7) that are formed on a PCB 70 to be described later. The inserted connection pins 50 may provide firm coupling between the shield housing 25 and the PCB 70, and may maintain sealing of the bottom surface of the shield housing 25 and the upper surface of the PCB 70 to effect complete shielding.

The second cover portion 30 may be connected to the rear of the first cover portion 20. The second cover portion 30 may be connected to the first cover portion 20 to provide an accommodation space in which the fixed body 60 is accommodated. The bottom surfaces of the first cover portion 20 and the second cover portion 30 may be positioned on the same plane, and the open lower portions of the first cover portion 20 and the second cover portion 30 come in contact with the upper portion of the PCB 70 to be closed from the outside.

The second cover portion 30 may be provided with a second rear shield plate 301 and a second side shield plate 302. The second rear shield plate 301 may be positioned from the rear end of an upper surface of the first body 201 to the rear side, and the second side shield plate 302 may be connected between the rear end surfaces of the second rear shield plate 301 and the first cover portion 20. Accordingly, the first cover portion 20 and the second cover portion 30 may be closely provided in a body.

The second rear shield plate 301 may be positioned to be slanted downward at a predetermined angle toward the rear side. In this case, the cross-sectional area of the accommodation space that is formed in the second cover portion 30 may be reduced as going toward the rear side.

The shield housing 25 may further include a second shield member 40. The second shield member 40 may project from the lower end portion of the second cover portion 30 toward the rear side. The bottom surface of the second shield member 40 may be positioned upper than the bottom surface of the second cover portion 30 to be even to the bottom surface of the second cover portion 30. The second shield member 40 may come in close contact with an upper portion of a pad 80 (in FIG. 7) to be described later, and may be soldered to the pad 80 to be grounded with sealing maintained.

The outer surface of the second shield member 40 may have a convex shape to maximize the sealing with the pad through soldering.

That is, since the connection pins 50 provided on the bottom surface of the first shield member 202 are inserted into the through-holes 701 and 702 formed on the PCB 70 to be soldered, and the second shield member 40 is soldered to the pad 80, the shield housing 25 is closely sealed up with the PCB 70 of the shield housing 25, and thus electromagnetic waves that are generated from the shield housing 25 and the PCB 70 can be prevented from radiating to the outside.

Figure 7:
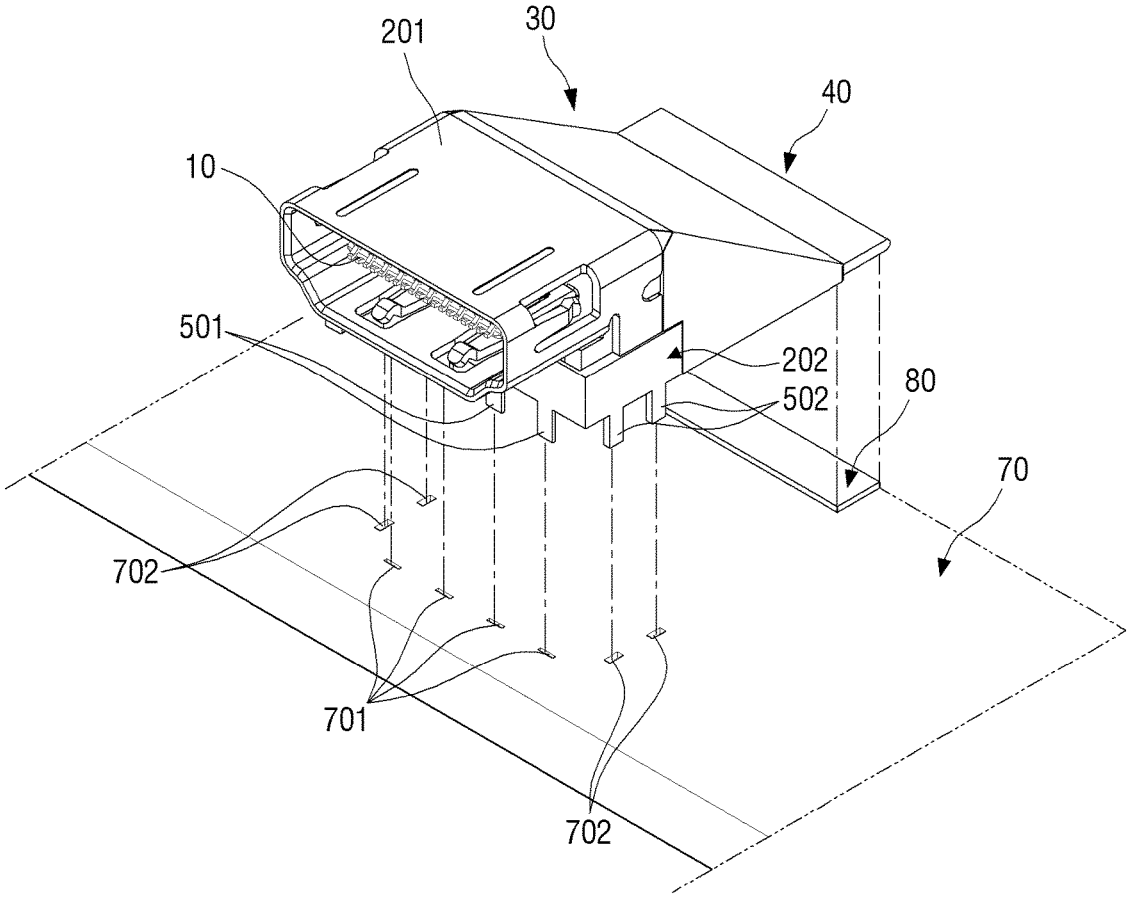
FIG. 7 is a perspective view illustrating a position where a connector according to an embodiment of the present disclosure is mounted on a printed circuit board.
Figure 8:
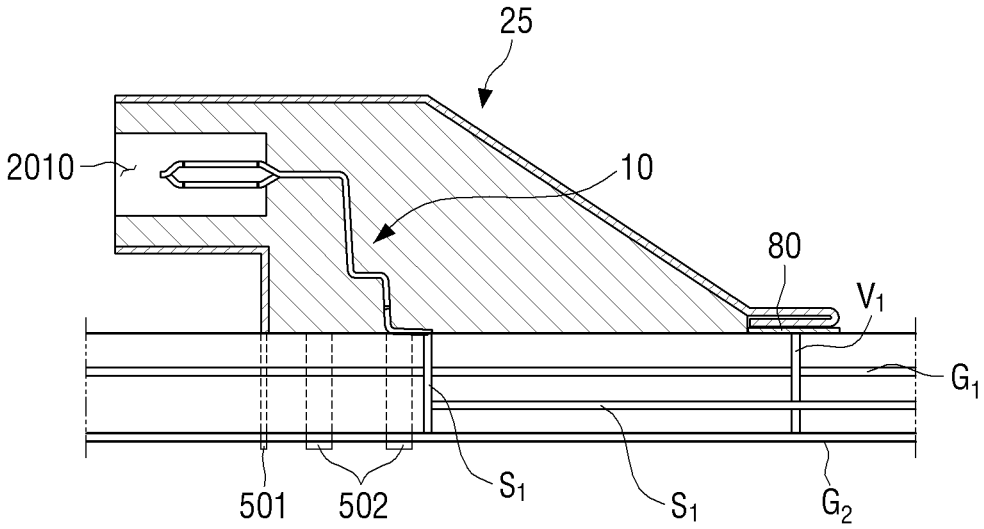
FIG. 8 is a cross-sectional view illustrating a state where a connector according to an embodiment of the present disclosure is mounted on a printed circuit board.

FIG. 7 is a perspective view illustrating a position where a connector according to an embodiment of the present disclosure is mounted on a printed circuit board, and FIG. 8 is a cross-sectional view illustrating a state where a connector according to an embodiment of the present disclosure is mounted on a printed circuit board. Explanation will be made around a shield structure in which the connector 1 as described above with reference to FIGS. 1 to 6 is mounted on the PCB 70, and omitted explanation may substitute for the contents as described above.

Referring to FIGS. 7 and 8, the connector 1 may be mounted on the PCB 70 in a manner that the front connection pin 501 and the side connection pin 502, which are provided on the bottom surface of the shield housing 25, are inserted into the through-holes 701 and 702 formed on the PCB 70. The through-holes 701 and 702 may be formed in the positions of the PCB 70, which correspond to the front connection pin 501 and the side connection pin 502. The through-holes 701 and 702 may include the front through-hole 701 that is formed in the position that corresponds to the front connection pin 501, and the side though-hole 702 that is formed in the position that corresponds to the side connection pint 502.

The pad 80 may be provided on the upper surface of the PCB 70. The pad 80 may be made of a metal that is a conductor through which electricity flows. The pad 80 may be provided in the position that corresponds to the second shield member 40 connected to the rear end portion of the shield housing 25, and may have a cross-sectional area that is larger than that of the second shield member 40. The second shield member 40 maybe soldered to the pad 80, and the rear portion of the shield housing may be firmly coupled to the PCB 70.

That is, the shield housing 25 may be firmly mounted on the PCB 70 in a manner that the connection pins 50 are inserted into the through-holes 701 and 702 to couple the front and the side of the shield housing 25 to the PCB 70, and the second shield member 40 is soldered to the pad 80 to couple the rear of the shield housing 25 to the PCB 70. In addition, since the sealing is maintained between the bottom surface of the shield housing 25 and the upper surface of the PCB 70, the inside of the shield housing 70 can be shielded as a whole to minimize EMI radiation.

As an example, the PCB 70 that is the essential element of an electronic product is grounded to eliminate factors that impede the performance of the PCB, such as EMI (Electro-Magnetic Interference) or ESD (Electro-Static Discharge).

The PCB 70 has a multilayer structure in which a conductive metal layer is plated on upper and lower surfaces of a panel that is formed of an insulating material for pattern connection. The PCB 70 has a structure in which various kinds of circuit patterns and circuit elements are mounted on the surface of the conductive metal layer. Further, the positions of signal lines and grounds and the number of surfaces and layers of the PCB may be changed.

As an example, the lower terminal portion 11 may be connected to a signal pattern $S_1$ that is arranged on the third layer. The front connection pin 501 and the side connection pin 502 stably couple the connector 1 and the PCB 70 to each other, and the second and fourth layers of the PCB 70 come in contact with barrel grounds $G_1$ and $G_2$ to maintain a stable ground.

In addition, the pad 80 can stably couple the connector 1 and the PCB 70 to each other through soldering, and a via-hole $V_1$ may be provided on the lower portion of the pad 80. Since the pad 80 comes in contact with the barrel grounds $G_1$ and $G_2$ on the second and fourth layers through the via-hole $V_1$, a stable ground can be maintained.

Figure 9:
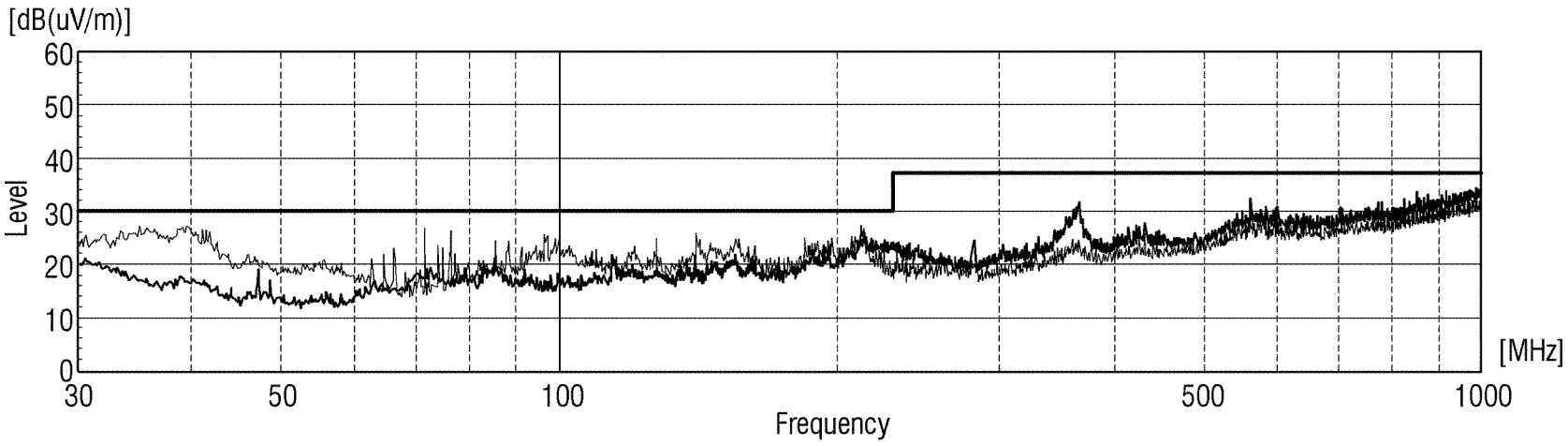
FIG. 9 is a graph illustrating EMI data of a connector according to an embodiment of the present disclosure.

FIG. 9 is a graph illustrating EMI data of a connector according to an embodiment of the present disclosure.

Referring to FIG. 9, it can be known that through the connector according to an embodiment of the present disclosure, EMI is lower than or reduced as compared to a predetermined standard that radiates at 0 to 1000 MHz.

Figure 10:
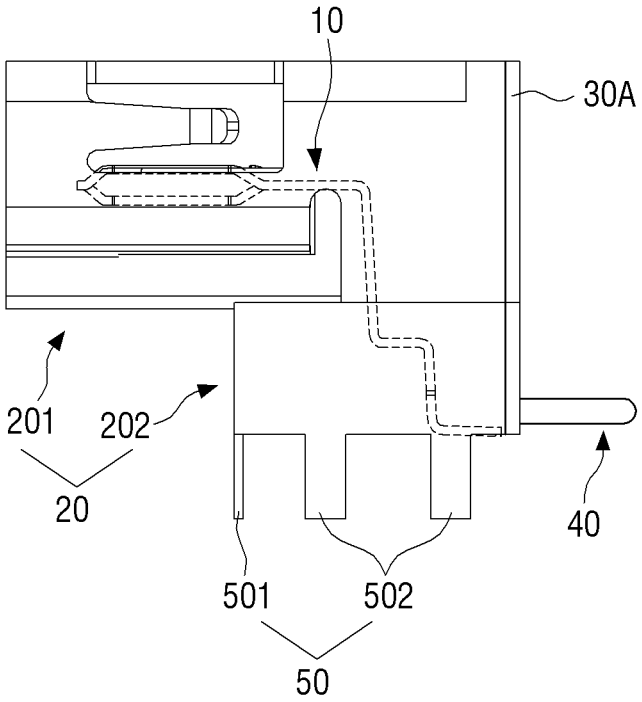
FIG. 10 is a side view illustrating a connector according to another embodiment of the present disclosure.

FIG. 10 is a side view illustrating a connector according to another embodiment of the present disclosure. Hereinafter, explanation will be made around a difference between a connector according to this embodiment and the connector as described above with reference to FIGS. 1 to 9, and omitted explanation may substitute for the contents as described above.

Referring to FIG. 10, the shield housing 25 may include a first cover portion 20 having a first body 201 into which a cable for connecting to an external system is inserted, and a second cover portion 30A that is connected to the rear of the first cover portion 20. In this case, the second cover portion 30A may be connected to the first cover portion 20 to provide an accommodation space for accommodating the fixed body 60.

The first body 201 may have a hollow portion 2010 having one open front side so that the conductive terminal 10 that is accommodated in the fixed body 60 can be connected to the cable. The hollow portion 2010 may provide a space into which the cable is inserted, and may be formed with a minimum size so that the cable is inserted into the hollow portion 2010. Further, the shape of the hollow portion 2010 may be changed to a shape that corresponds to the shape of the cable.

A first shield member 202 may be connected to a lower portion of the first body 201. The first shield member 202 may be shaped to surround a front and both sides of the fixed body 60. The first shield member 202 may be provided with a first front shield plate 2021 and a first side shield plate 2022. Here, the first front shield plate 2021 may be positioned in front of the fixed body 60, and the first side shield plate 2022 may be positioned on both sides of the fixed body 60.

A connection pin 50 may be provided on bottom surfaces of the first front shield plate 2021 and the first side shield plate 2022. The connection pin 50 may be provided with a first front connection pin 501 and a first side connection pin 502. Here, the first front connection pin 501 may be positioned on the bottom surface of the first front shield plate 2021, and the first side shield plate 502 may be positioned on the bottom surface of the first side shield plate 2022.

A second cover portion 30A is connected to the first cover portion 20. The second cover portion 30A may be positioned in parallel to the first front shield plate 2021, and may be positioned to be spaced apart from the first front shield plate 2021 at predetermined intervals. The second cover portion 30A may close the open rear portion of the first cover portion 20 to provide an accommodation space. Since the second cover portion 30A is positioned in parallel to the first front shield plate 2021, the position in which the connector 1 is mounted on the PCB 70 can be minimized, and interference in designing signal lines on the PCB 70 can be prevented to implement the optimum design.

An external device, such as a USB memory, may be directly connected to the connector 1, and a cable having a terminal, such as a power, USB, or HDMI, may be connected to the connector 1. The shape of the connector 1 is not limited to the shape as illustrated in the drawing, but any shape of the connector 1 may be provided to correspond to various kinds of terminals that are provided in the external device or the cable.

Although the various embodiments of the present disclosure have been individually explained, these embodiments are not required to be independently implemented, but the configurations and operations of the respective embodiments may be implemented in combination with at least one other embodiment.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

Although a few embodiments have been shown and described, it would be appreciated by those skilled in the art that changes may be made in these embodiments without departing from the principles and spirit thereof, the scope of which is defined in the claims and their equivalents.

What is claimed is:

1. A connector, comprising:

a conductive terminal;

a fixed body configured to accommodate the conductive terminal therein; and a shield housing having an open lower portion through which a lower end portion of the conductive terminal is connected to a printed circuit board and formed in a body to accommodate the conductive terminal and the fixed body, wherein a bottom surface of the shield housing comes into contact with the printed circuit board to make the lower end portion of the conductive terminal closed from an outside, wherein the shield housing includes:

a cover portion including a body having a front portion in which a hollow portion is formed to insert a cable, for connecting to an external system, into the hollow portion; and a shield member connected to a lower portion of the body, and the shield member having a bottom surface that comes into contact with the printed circuit board;

wherein the shield member includes:

a front shield plate positioned in front of the fixed body; and a side shield plate connected to both sides of the front shield plate to project toward the fixed body.

2. The connector as claimed in claim 1, wherein the cover portion is a first cover portion, and the shield housing further includes:

a second cover portion connected to a rear of the first cover portion to provide an accommodation space for accommodating the fixed body and having a bottom surface that comes into contact with the printed circuit board.

3. The connector as claimed in claim 1, wherein the first cover portion further includes a connection pin configured to project from a bottom surface of the first shield member and to be inserted into an insertion hole penetratingly formed in a thickness direction of the printed circuit board.

4. The connector as claimed in claim 3, wherein the connection pin comprises:

a front connection pin provided on the front shield plate; and a side connection pin provided on the side shield plate.

5. The connector as claimed in claim 4, wherein the front connection pin is among a plurality of front connection pins and the side connection pin is among a plurality of side connection pins, the front shield plate has a width larger than a width of the side shield plate, and a number of first front connection pins among the plurality of front connection pins are larger than a number of first side connection pins among the plurality of side connection pins.

6. The connector as claimed in claim 4, wherein the front connection pin and the side connection pin have shapes corresponding to each other.

7. The connector as claimed in claim 2, wherein the front shield plate and the second cover portion are positioned in parallel.

8. The connector as claimed in claim 2, wherein the second cover portion includes:

a second rear shield plate connected to an upper surface of the body; and a second side shield plate connected between the second rear shield plate and the first cover portion.

9. The connector as claimed in claim 2, further comprising a second shield member configured to project rearwardly from a lower end portion of the second cover portion and to be grounded to the printed circuit board.

10. The connector as claimed in claim 9, wherein an outer surface of the second shield member has a convex shape.

11. The connector as claimed in claim 2, wherein the second cover portion is shaped to reduce the accommodation space rearwardly.

12. The connector as claimed in claim 2, wherein the bottom surface of the first cover portion and the bottom surface of the second cover portion are positioned on a same plane.

13. A connector mounted on a printed circuit board, on which a via-hole for connecting a circuit pattern of a multilayered board layer and a through-hole penetratingly formed in a thickness direction are formed, the connector comprising:

a shield housing configured to accommodate therein a conductive terminal that electrically connects an external system and the circuit pattern, wherein a connection pin, provided on a bottom surface of the shield housing, is inserted into the through-hole, and the bottom surface of the shield housing comes into contact with the printed circuit board to form an accommodation space closed from an outside, wherein the shield housing includes:

a cover portion including a body having a hollow portion into which a cable, for connecting to an external system, is inserted; and a shield member connected to a lower portion of the body and having a bottom surface that comes into contact with the printed circuit board;

wherein the shield member includes:

a front shield plate positioned in front of the fixed body; and a side shield plate connected to both sides of the front shield plate to project toward the fixed body.

14. The connector as claimed in claim 13, wherein the cover portion is a first cover portion, and the shield housing further includes:

a second cover portion connected to a rear of the first cover portion to provide an accommodation space for accommodating the fixed body and having a bottom surface that comes into contact with the printed circuit board.

15. The connector as claimed in claim 14, wherein a plurality of through-holes are formed in predetermined positions of the printed circuit board, and the connection pin is formed in a position corresponding to the through-hole, among the plurality of through-holes, from the bottom surface of the shield member.

16. The connector as claimed in claim 14, further comprising a second shield member configured to project from a lower end portion of the second cover portion toward a rear side and to be grounded to the printed circuit board.

17. The connector as claimed in claim 16, further comprising a pad provided on the printed circuit board to face the second shield member to fix the printed circuit board and the connector to each other.

18. The connector as claimed in claim 17, wherein the printed circuit board comprises a plurality of ground layers and a ground via-hole connected to the pad to ground respective ground layers.

19. The connector as claimed in claim 13, wherein the printed circuit board comprises a plurality of ground layers, and the through-hole is connected to the connection pin to ground respective ground layers.

* * * * *